US010080939B2

(12) United States Patent
Hazy

(10) Patent No.: US 10,080,939 B2
(45) Date of Patent: Sep. 25, 2018

(54) PREFORMED LACROSSE POCKET

(71) Applicant: Phantom Lacrosse, Inc., Austin, TX (US)

(72) Inventor: Michael William Hazy, Austin, TX (US)

(73) Assignee: PHANTOM LACROSSE, INC., Austin, TX (US)

( * ) Notice: Subject to any disclaimer, the term of this patent is extended or adjusted under 35 U.S.C. 154(b) by 36 days.

(21) Appl. No.: 14/952,647

(22) Filed: Nov. 25, 2015

(65) Prior Publication Data

US 2017/0144040 A1 May 25, 2017

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20
USPC ..... 473/513
See application file for complete search history.

(56) References Cited

U.S. PATENT DOCUMENTS 5,174,580 A * 12/1992 Pratt ..... A63B 59/20 473/513
5,269,532 A * 12/1993 Tucker ..... A63B 59/20 473/513
6,902,501 B2 6/2005 Morrow et al.
7,022,035 B2 4/2006 Morrow et al.
7,338,396 B2 * 3/2008 Gait ..... A63B 59/20 473/513
9,162,382 B2 * 10/2015 Burns ..... B29C 70/688
2002/0160865 A1 10/2002 Brine, III et al.
2004/0029657 A1 2/2004 Scaramuzzino et al.
2009/0203474 A1 * 8/2009 Tucker, Sr. ..... A63B 59/20 473/513
2014/0349789 A1 11/2014 Szurley et al.

OTHER PUBLICATIONS

European Search Report, Application No. EP 16 17 6615, dated Dec. 1, 2016, 8 pages.

* cited by examiner

*Primary Examiner* — Melba Bumgarner
*Assistant Examiner* — Laura L Davison
(74) *Attorney, Agent, or Firm* — Baker Botts L.L.P.

(57) ABSTRACT

A preformed lacrosse pocket, including a pocket material is disclosed. The pocket material includes a throat fastener zone, including a plurality of throat fastener apertures configured to accept a plurality of throat fasteners operable to couple the throat fastener zone to a throat region of a lacrosse head, and a channel zone adjacent to the throat fastener zone extending distally from the throat fastener zone. The pocket material is further formed to include a pair of sidewall zones adjacent to the channel zone, the sidewalls zones configured to define voids between the lacrosse head and the pocket material, when installed in the lacrosse head, scoop zone adjacent to the channel zone and the pair of sidewall zones, including a plurality of scoop fastener apertures configured to accept a plurality of scoop fasteners operable to couple the scoop fastener zone to a scoop region of the lacrosse head.

35 Claims, 8 Drawing Sheets

PREFORMED LACROSSE POCKET

TECHNICAL FIELD

The present disclosure relates to lacrosse equipment, and, more particularly, to preformed lacrosse pockets.

BACKGROUND

Conventional lacrosse sticks typically include a head joined with a handle. The head may include a frame that forms a region within which a lacrosse pocket can be attached. Typically, the lacrosse pocket is constructed from laces or mesh, and connected to the back of the head. The lacrosse pocket is configured to retain a lacrosse ball, and enable a lacrosse player to catch, throw, and retain a lacrosse ball. Accordingly, features of a lacrosse pocket may affect the usability of lacrosse sticks.

SUMMARY

A preformed lacrosse pocket, including a pocket material is disclosed. The pocket materials may be formed to include a throat fastener zone, including a plurality of throat fastener apertures configured to accept a plurality of throat fasteners operable to couple the throat fastener zone to a throat region of a lacrosse head, and a channel zone adjacent to the throat fastener zone extending distally from the throat fastener zone. The pocket material is further formed to include a pair of sidewall zones adjacent to the channel zone, the sidewalls zones configured to define voids between the lacrosse head and the pocket material, when installed in the lacrosse head, scoop zone adjacent to the channel zone and the pair of sidewall zones, including a plurality of scoop fastener apertures configured to accept a plurality of scoop fasteners operable to couple the scoop fastener zone to a scoop region of the lacrosse head.

A lacrosse head, including a frame with a throat region, a pair of side regions, adjacent to the throat region, and a scoop region, adjacent to the pair of side regions is disclosed. The lacrosse head may include a preformed lacrosse pocket, coupled to the frame, including a pocket material. The pocket material is formed to include a throat fastener zone, including a plurality of throat fasteners apertures configured to accept a plurality of throat fasteners operable to couple the throat fastener zone to the throat region and a channel zone adjacent to the throat fastener zone extending distally from the throat fastener zone. The pocket material is further formed to include a pair of sidewall zones adjacent to the channel zone, the sidewalls zones configured to define voids between the frame and the pocket material, and a scoop zone adjacent to the channel zone and the pair of sidewall zones, including a plurality of scoop fastener apertures configured to accept a plurality of scoop fasteners operable to couple the scoop fastener zone to the scoop region of the frame.

A lacrosse stick is disclosed, the lacrosse stick including a handle, a lacrosse head, coupled to the handle, and a preformed lacrosse pocket, coupled to the lacrosse head. The lacrosse head including a throat region, a pair of side regions, adjacent to the throat region, and a scoop region, adjacent to the pair of side regions. The preformed lacrosse pocket including a pocket material formed to include a throat fastener zone, including a plurality of throat fasteners apertures configured to accept a plurality of throat fasteners operable to couple the throat fastener zone to a throat region of a lacrosse head, and a channel zone adjacent to the throat fastener zone extending distally from the throat fastener zone. The pocket material further includes a pair of sidewall zones adjacent to the channel zone, the sidewalls zones configured to define voids between the lacrosse head and the pocket material, when installed in the lacrosse head, and a scoop zone adjacent to the channel zone and the pair of sidewall zones, including a plurality of scoop fastener apertures configured to accept a plurality of scoop fasteners operable to couple the scoop fastener zone to a scoop region of the lacrosse head.

BRIEF DESCRIPTION OF THE DRAWINGS

For a more complete understanding of the present disclosure and its features and advantages, reference is now made to the following description, taken in conjunction with the accompanying drawings, which may include drawings that are not to scale and drawings that are to scale, and wherein like reference numbers indicate like features, in which.

DETAILED DESCRIPTION

Figure 1:
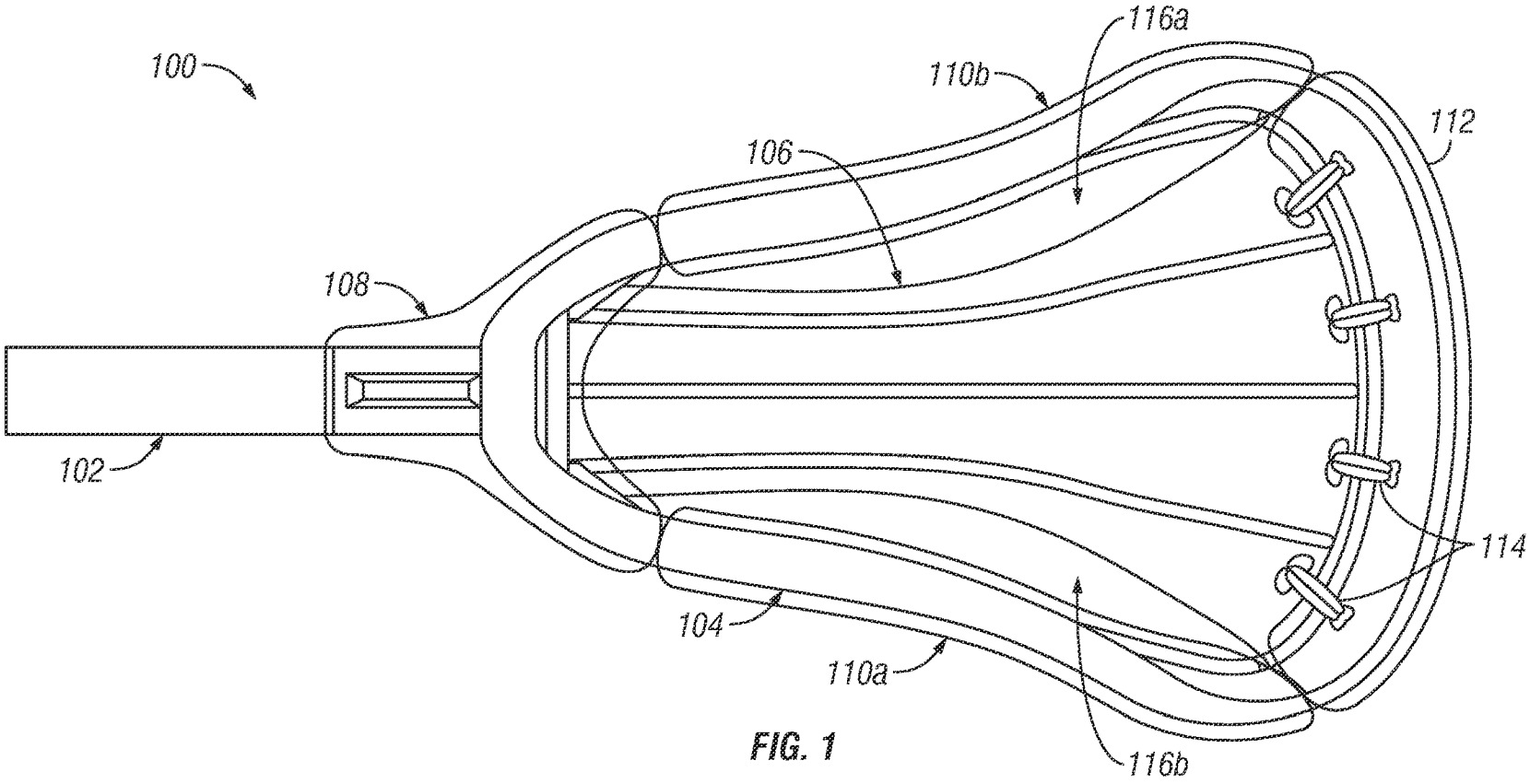
FIG. 1 illustrates a lacrosse stick in accordance with embodiments of the present disclosure.

FIG. 1 illustrates an exemplary lacrosse stick in accordance with embodiments of the present disclosure. In the game of lacrosse, players may use lacrosse stick 100 to throw, catch, pick up, or shoot a lacrosse ball. Accordingly, features of lacrosse stick 100 may impact lacrosse gameplay, including the ability to effectively throw, catch, gain possession of, or retain possession of a lacrosse ball. Lacrosse stick 100 may include handle 102, head 104 and preformed lacrosse pocket 106. Head 104 head may be attached to one end of handle 102, and may define a void where preformed lacrosse pocket 106 may be attached. Preformed lacrosse pocket 106 may be attached to head 104 of lacrosse stick 100, and may operate (in conjunction with other portions of lacrosse stick 100) to catch a lacrosse ball, to maintain possession of a lacrosse ball, to pick up a lacrosse ball, or to facilitate throwing a lacrosse ball. Accordingly, features of preformed lacrosse pocket 106 may affect many aspects of lacrosse gameplay. Typically, players select from one of a variety of conventional lacrosse pockets, such as a traditional pocket (leather thongs secured by lacing) or a mesh pocket (a continuous mesh piece commonly woven from nylon threads). However, these types of conventional pockets may suffer from flaws in durability, usability, game performance, or some combination of these. Accordingly, players may elect to use a preformed lacrosse pocket in accordance with embodiments of the present disclosure. Features and advantages of a preformed lacrosse pocket are described in more detail below with reference to FIGS. 1-7.

Lacrosse stick 100 may include handle 102. Handle 102 may include any suitable handle or shaft. Typically, a lacrosse handle may be between 20 and 70 inches in length, but any suitable handle length may be used. Handle 102 may be formed from of aluminum, titanium, scandium, or alloys thereof. Handle 102 may also be formed from wood, plastic, or fiberglass, or any other suitable material. Handle 102 may have an octagonal cross-section, a circular cross-section, a polygonal cross-section, or may have any other suitable cross-section. Handle 102 may be configured to be coupled to head 104. For example, head 104 may include a recess into which handle 102 may be inserted and secured, usually with a screw.

Head 104 may include a frame that is configured to define a void within which preformed lacrosse pocket 106 may be secured. Accordingly, the frame of head 104 may include various regions. For example, head 104 may include throat region 108. Throat region 108 may include the portion of head 104 proximate to handle 102. Throat region 108 may be configured to be attached to handle 102. Throat region 108 may extend laterally to the sides of head 104, and may curve away from handle 102. Throat region 108 may be adjacent to side regions 110*a* and 110*b* (collectively "side regions 110") of head 104. Side regions 110 may extend away from throat region 108. As depicted in FIG. 1, side regions 110 may be approximately parallel to each other in the portion of head 104 that is closest to handle 102. Side regions 110 may curve laterally outward in the portion of head 104 that is farthest away from throat region 108. Side regions 110 may be coupled to scoop region 112. Scoop region 112 may include the portion of head 104 disposed at the opposite end from throat region 108. The various regions of head 104 may define a void where preformed lacrosse pocket 106 may be coupled to head 104. For example, head 104 may be configured to retain any preformed lacrosse pocket in accordance with embodiments of the present disclosure.

Figure 2:
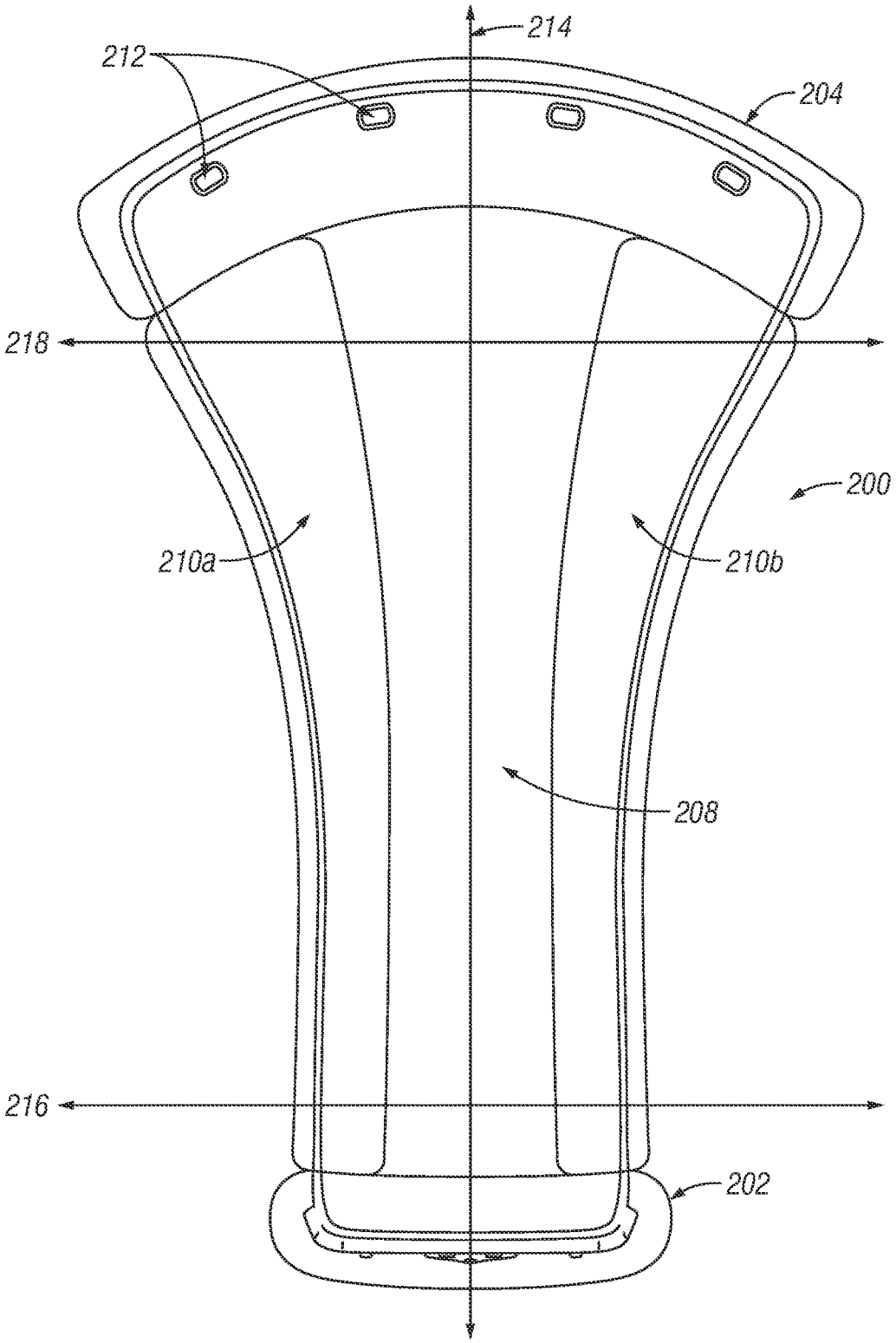
FIG. 2 illustrates a scale drawing of a front view of a preformed lacrosse pocket in accordance with embodiments of the present disclosure.

FIG. 2 illustrates a scale drawing of a front view of a preformed lacrosse pocket in accordance with embodiments of the present disclosure. In some embodiments, preformed lacrosse pocket 200 may be integrally formed from a single piece of pocket material. In further embodiments, preformed lacrosse pocket 200 may be formed from multiple pieces of pocket material, which are joined together to form preformed lacrosse pocket 200. Regardless of how many pieces of pocket material are used to form preformed lacrosse pocket 200, preformed lacrosse pocket 200 may include various zones. As described herein, the configurations of these zones may define various features of preformed lacrosse pocket 200.

For example, lacrosse pocket 200 may include throat zone 202. Throat zone 202 may include the portion of preformed lacrosse pocket 200 configured to be coupled to the throat region of a lacrosse head. Throat zone 202 is described in more detail below with reference to FIG. 7. Throat zone 202 may be adjacent to channel zone 208 and sidewall zones 210*a* and 210*b* (collectively "sidewall zones 210").

Preformed lacrosse pocket 200 may also include channel zone 208. Channel zone 208 may be adjacent to throat zone 202. Channel zone 208 may extend distally from throat fastener zone 202 towards scoop zone 204. Channel zone 208 may be between about 30 mm and 100 mm wide, measured along the surface of preformed lacrosse pocket 200, perpendicular to central axis 214. Channel zone 208 may be between about 150 mm and 350 mm long, measured along the surface of preformed lacrosse pocket 200, along central axis 214. As described below with reference to FIG. 3, channel zone 308 may be deepest along central axis 214, and may curve upward toward sidewall zones 210 on either side of central axis 214.

Preformed lacrosse pocket 200 may also include sidewall zones 210. Sidewall zones 210 may each be between about 5 mm and 40 mm wide at plane 216 (measured along the surface of preformed lacrosse pocket 200, along plane 216). Plane 216 may intersect preformed lacrosse pocket 200 close to the area where throat fastener zone 202 joins with channel zone 208 and sidewall zones 210. Sidewall zones 210 may each be between about 10 mm and 60 mm wide at plane 218 (measured along the surface of preformed lacrosse pocket 200, along plane 218). Plane 218 may intersect preformed lacrosse pocket 200 close to the area where scoop zone 204 joins with channel zone 208 and sidewall zones 210. As described below with reference to FIG. 3, sidewall zones 210 may curve upward on either side of central axis 214, and may thus, in conjunction with channel zone 208, form a channel operable to retain, throw and catch a lacrosse ball.

Preformed lacrosse pocket 200 may also include scoop zone 204. Scoop zone 204 may be adjacent to channel zone 208 and sidewall zones 210. Scoop zone 204 may include a plurality of scoop fastener apertures 212 configured to be coupled to a scoop region of a lacrosse head, such as scoop region 112 of head 104, described above with reference to FIG. 1. Scoop zone 204 may be between about 120 mm and 180 mm wide (measured along the surface of preformed lacrosse pocket 200, perpendicular to central axis 214), and may include the portion of preformed lacrosse pocket 200 extending between about 20 mm and 80 mm in from the scoop end of preformed lacrosse pocket 200 (measured along the surface of preformed lacrosse pocket 200, along central axis 214).

Preformed lacrosse pocket 200 may be formed from a pocket material selected to minimize or eliminate the need for adjusting preformed lacrosse pocket 200. Previous types of lacrosse pockets are commonly delivered to a player pre-installed in a head. For example, in the case of a mesh pocket, the mesh may be tied to a head using strings. However, the mesh and strings must be adjusted to achieve an optimal shape and tension throughout the surface of a mesh pocket. Incorrectly adjusting a mesh may cause substantial difficulties in throwing or catching a lacrosse ball. Correctly adjusting a mesh head may require specialized knowledge, skills, or equipment. Players lacking this knowledge may need to seek out assistance of others to adjust the lacrosse pocket so that throwing and catching the ball is possible. Furthermore, many players—especially beginners—have never used a correctly adjusted pocket and, therefore, have no standard to gauge the performance of their pocket. In many cases, players use pockets that are only marginally effective and are consequently unable to improve their skills.

This adjustment problem may be exacerbated by time-dependent and playing-condition dependent changes in conventional pocket performance. Even correctly adjusted lacrosse pockets may change over time, possibly requiring further adjustment. For example, new pockets may have a break-in period where a player must deepen a specific section of the pocket according to their style of play. Typically, this is accomplished by throwing and catching a lacrosse ball hundreds of times. This process may cause the material of a mesh lacrosse pocket to stretch, or may cause the strings used to affix the mesh lacrosse pocket to the head to stretch. This stretching may cause the shape of a mesh lacrosse pocket to change, altering the performance of the pocket. Accordingly, during this break-in period, a mesh lacrosse pocket may require adjustment to maintain a consistent level of performance. Even after this break-in period, exposure to wet and dry conditions may require further adjustment. The materials used to form a mesh lacrosse pockets may deform in the presence of water. Thus, when playing in wet conditions, the shape of a mesh lacrosse pocket may be deformed. After a mesh lacrosse pocket dries out again, the shape may not return to its original state. Accordingly, exposure to different playing conditions may require further adjustment of a mesh lacrosse pocket. Traditional lacrosse pockets may suffer from the same effects.

By contrast, preformed lacrosse pocket 200 may be implemented using a material that does not require a break-in process and is unaffected by exposure to wet or dry conditions. For example, preformed lacrosse pocket may be formed from a durable material, such as thermoplastic polyurethane. Thermoplastic polyurethane may describe a class of materials formed of organic units joined by carbamate (urethane) links. Thermoplastic polyurethane materials may be engineered to take on a variety of physical properties. For example, thermoplastic polyurethane may be engineered to have a variety of densities or hardnesses. Additionally, thermoplastic polyurethane may be engineered to have various colors or opacities, and may be engineered to be clear. A preformed lacrosse pocket in accordance with the present disclosure may maintain its shape throughout the lifetime of the pocket, and may be unaffected by exposure to wet or dry conditions. Although it has been found that thermoplastic polyurethane may be suitable for use in forming preformed lacrosse pockets, other materials may be used. For example, thermoplastic polymers, rubber, nylon, resins, or any other suitable material may be used.

To receive a ball, a lacrosse pocket must be flexible or the ball may bounce off the pocket. Existing mesh pockets may vary in flexibility from soft to hard depending on the manufacturer's balancing of certain factors: a soft mesh pocket may be more capable of receiving a ball and has a shorter break-in period but requires more adjustment. A hard mesh may have the opposite attributes. In addition, a hard mesh pocket often contains stiff waves in the material, adversely affecting performance. A preformed lacrosse pocket in accordance with the present disclosure may be designed to balance these considerations by choosing an appropriately flexible material. For example, as previously described, thermoplastic polyurethane materials may be engineered to have a variety of properties, including various hardnesses. It may be preferred that preformed lacrosse pocket 200 be implemented using a pocket material engineered to have a hardness of between about 65 and about 95 on the Shore A scale of hardness (or equivalent); however, another range of hardness may also be suitable. With the exception of certain reinforcing areas (described below in further detail with reference to FIGS. 5-7), preformed lacrosse pocket 200 may be designed to have a generally uniform thickness. Preferably, preformed lacrosse pocket 200 may be between about 0.5 mm and about 5 mm thick. However, preformed lacrosse pocket 200 may also be between about 0.1 mm and about 10 mm thick.

In some embodiments, preformed lacrosse pocket 200 may be formed in part or in whole from an optically clear pocket material. In some lacrosse forums, regulations prohibit pockets that conceal the appearance of the ball in the pocket. Accordingly, a preformed lacrosse pocket may be formed from optically clear pocket material, such as optically clear thermoplastic polyurethane, or any other suitable optically clear pocket material. Because, in some embodiments, preformed lacrosse pocket 200 may be formed in part or in whole from optically clear pocket material, preformed lacrosse pocket 200 may have superior ball visibility as compared to traditional pockets or mesh pockets. By contrast, a preformed lacrosse pocket including a foam layer would be opaque because foams are not optically clear.

In some embodiments of the present disclosure, performed lacrosse pocket 200 may include a solid piece of pocket material with apertures, such as scoop fastener apertures, for affixing preformed lacrosse pocket 200 to a lacrosse head. As previously described, conventional lacrosse pockets may be formed from mesh or a combination of leather cords and nylon lacing. In these conventional lacrosse pockets, a mesh may be woven to form a net or other pattern that includes multiple openings through the pocket material in addition to those openings used to fasten the conventional pocket to a lacrosse head. In some embodiments of the present disclosure, with the exception of apertures used to fasten preformed lacrosse pocket 200 to a lacrosse head, preformed lacrosse pocket 200 may not have other apertures. Effectively, preformed lacrosse pocket 200 may be formed from a solid piece of pocket material. In other embodiments, preformed lacrosse pocket 200 may include apertures that mimic existing mesh pockets. In some embodiments of the present disclosure, preformed lacrosse pocket 200 may including apertures that cover about 0%, 1%, 5%, 10%, 15%, 20%, 25%, 30%, 35%, 40%, 45%, 50%, 55%, 60%, 65%, 70%, 75% or up to 80% of the surface area of preformed lacrosse pocket 200.

Returning to FIG. 1, preformed lacrosse pocket 106 may have a floating sidewall. Conventional lacrosse pockets may be connected to lacrosse heads using fasteners, such as strings, along the entire circumference of the lacrosse head, including throat zone 108, side zones 110, and scoop zone 112. By contrast, a preformed lacrosse pocket in accordance with embodiments of the present disclosure may be connected only to the throat zone 108 and scoop zone 112 of head 104. Many lacrosse heads have a unique sidewall shape, and so, when using a conventional lacrosse pocket, a pocket must be affixed in a manner compatible with the particular sidewall shape of the lacrosse head. Although preformed lacrosse heads in accordance with embodiments of the present disclosure may be formed with different dimensions to accommodate differently shaped heads, the geometry of the head sidewall may not affect the compatibility of a preformed lacrosse pocket and a head. Because the sidewall zones of a preformed lacrosse pocket are not affixed to the lacrosse head, these sidewall zones may be referred to as "floating sidewall zones." In further embodiments, however, sidewall zones may be connected to a side region of a lacrosse head by portions of pocket material.

Floating sidewall zones in accordance with embodiments of the present disclosure may have several advantages. For example, lacrosse players often prefer equipment that incurs less air resistance as the equipment is moved during gameplay. When installed in a lacrosse head, voids 116*a* and 116*b* (collective "voids 116") may include the area between preformed lacrosse pocket 106 and head 104. Although FIG. 1 illustrates two voids 116, those voids may be subdivided into smaller voids by a plurality of fingers extending from preformed lacrosse pocket or by discrete fasteners connecting sidewall zones to a side region. In either configuration, voids 116 may allow air to freely pass through head 104 when lacrosse stick 100 is moved, thus reducing air resistance. The area of voids 116 may include the areas between preformed lacrosse pocket 106 and head 104, when viewed from the front of head 104, as depicted in FIG. 1. The total area of voids 116 may be compared to the total area within head 104. In accordance with the present disclosure, preformed lacrosse pocket 106 may be designed to include voids that total about 0%, 1%, 5%, 10%, 15%, 20%, 25%, 30%, 35%, 40%, 45%, 50%, 55%, or up to 60% of the total area within head 104.

Another advantage of a floating sidewall may be that a preformed lacrosse pocket may be narrow enough to allow manual correction if pocket inversion occurs. During game play, the rear side of a lacrosse pocket may be impacted (by, for example, a ball, a piece of equipment, another player, or the playing surface). Because a preformed lacrosse pocket may be implemented using a flexible material, this impact on the rear of a preformed lacrosse pocket may cause the pocket to invert through the lacrosse head. Accordingly, a preformed lacrosse pocket in accordance with the present disclosure may be narrow enough so that a player can manually return the preformed lacrosse pocket to its playing position.

Figure 3:
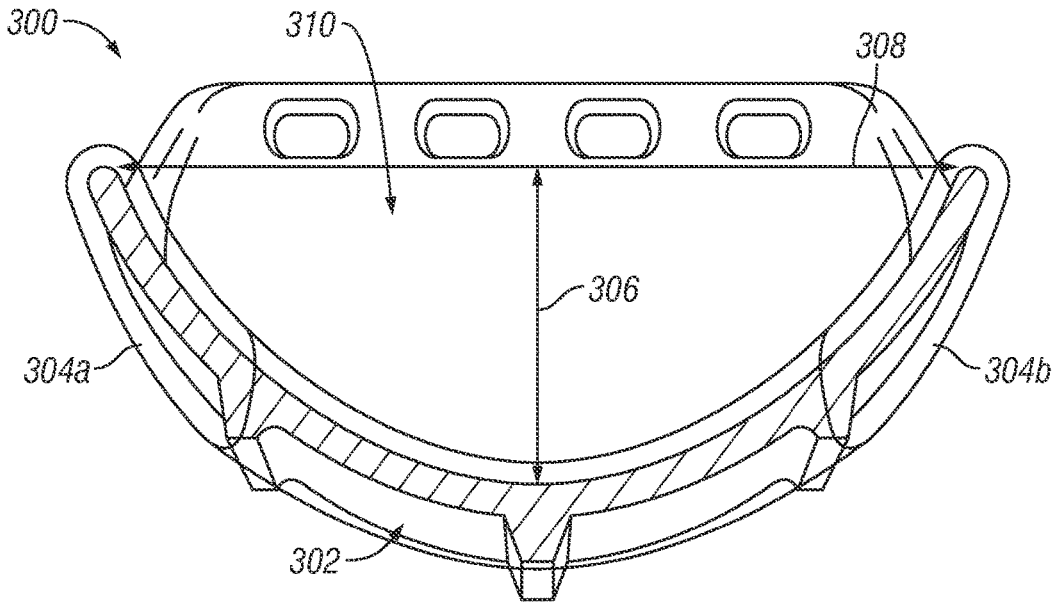
FIG. 3 illustrates a scale cross section of a channel of a preformed lacrosse pocket in accordance with embodiments of the present disclosure.

FIG. 3 illustrates a scale cross section of a channel of a preformed lacrosse pocket in accordance with embodiments of the present disclosure. Specifically, FIG. 3 illustrates a cross section at the midpoint of a hypothetical line connecting the throat end of preformed lacrosse head 300 with the scoop end of preformed lacrosse head 300 (such as line 406 in FIG. 4). The cross section may be in a plane perpendicular to this line (such as plane 430 illustrated in FIG. 4). The shape of a lacrosse pocket may affect the ability of a player to accurately manipulate a lacrosse ball. In particular, the shape of a lacrosse pocket may affect the ability of a player to catch, throw, pick up, or retain a lacrosse ball.

For example, when throwing, a lacrosse ball ideally moves within the pocket away from the handle and towards the scoop end of a lacrosse head, eventually exiting the lacrosse head. Ideally, prior to throwing a lacrosse ball, the lacrosse ball will be retained within the deepest part of a lacrosse pocket. A lacrosse player may use the handle of the lacrosse stick to move the lacrosse head and lacrosse pocket, forcing the lacrosse ball to move to the deepest part of the lacrosse pocket, and then when throwing, to leave the lacrosse pocket. Ideally, during this process, a lacrosse ball would follow a path straight down the center of the pocket. Conventional pockets, however, may allow the ball to travel in an off-center direction. For example, mesh pockets typically have the same width as a lacrosse head, resulting in a wide area in which the ball may travel. Likewise, traditional pockets have the same width as a lacrosse head. Conventional pockets may be adjusted to emulate a narrower channel in a portion of the lacrosse pocket, but this channel commonly widens through the top half of the pocket. Thus, in the top half of a conventional lacrosse pocket, a lacrosse ball may have a wide lateral distance in which the ball may travel. Accordingly, when a lacrosse ball is thrown using such a traditional lacrosse pocket or a mesh pocket, the lacrosse ball may move laterally, and thus deviate from the ideal throwing path down the center of the conventional pocket.

Similarly, when retaining (or "cradling") a lacrosse ball, a player may move a lacrosse stick to generate rotational forces to push the lacrosse ball into the deepest part of the pocket. However, in a conventional pocket, the wide channel may allow a lacrosse ball to move away from the center of the pocket and to collide with the side regions of the head, an undesirable effect known as "ball rattle."

By contrast, a preformed lacrosse pocket in accordance with embodiments of the present disclosure may be configured with a narrow channel through a larger portion of the preformed lacrosse pocket. For example, as depicted in FIG. 3, preformed lacrosse pocket 300 include a cross-section configured to retain a lacrosse ball. Channel 310 may include various zones of pocket material, such as those zones described above with references to FIG. 2. For example, channel 310 may include channel zone 302. Channel zone 302 may be approximately the width of a lacrosse ball. Channel zone 302 may be adjacent to sidewall zone 304*a* and sidewall zone 304*b* (collectively "sidewall zones 304"). Sidewall zones 304 may operate in conjunction with channel zone 302, to retain a lacrosse ball within generally "u-shaped" channel 310. In a cross section taken at the midpoint between the hypothetical line connecting the scoop and throat of preformed lacrosse pocket 300 (such as line 406 in FIG. 4), width of opening 308 of channel 310 may vary from about 50 mm to about 150 mm, measured along a hypothetical line connecting the ends of sidewall zones 304. Depth 306 of channel 310 may vary from about 5 mm to about 90 mm, measured perpendicular to a hypothetical line connecting the ends of sidewall zones 304, including the distance between such a line and the deepest portion of channel 310, measured in the plane of the cross section (such as plane 430 in FIG. 4). Forming channel 300 with these dimensions may operate to retain a lacrosse ball close to the centerline of the preformed lacrosse pocket, and thus to retain the ball in the desired section of the pocket.

Figure 4A:
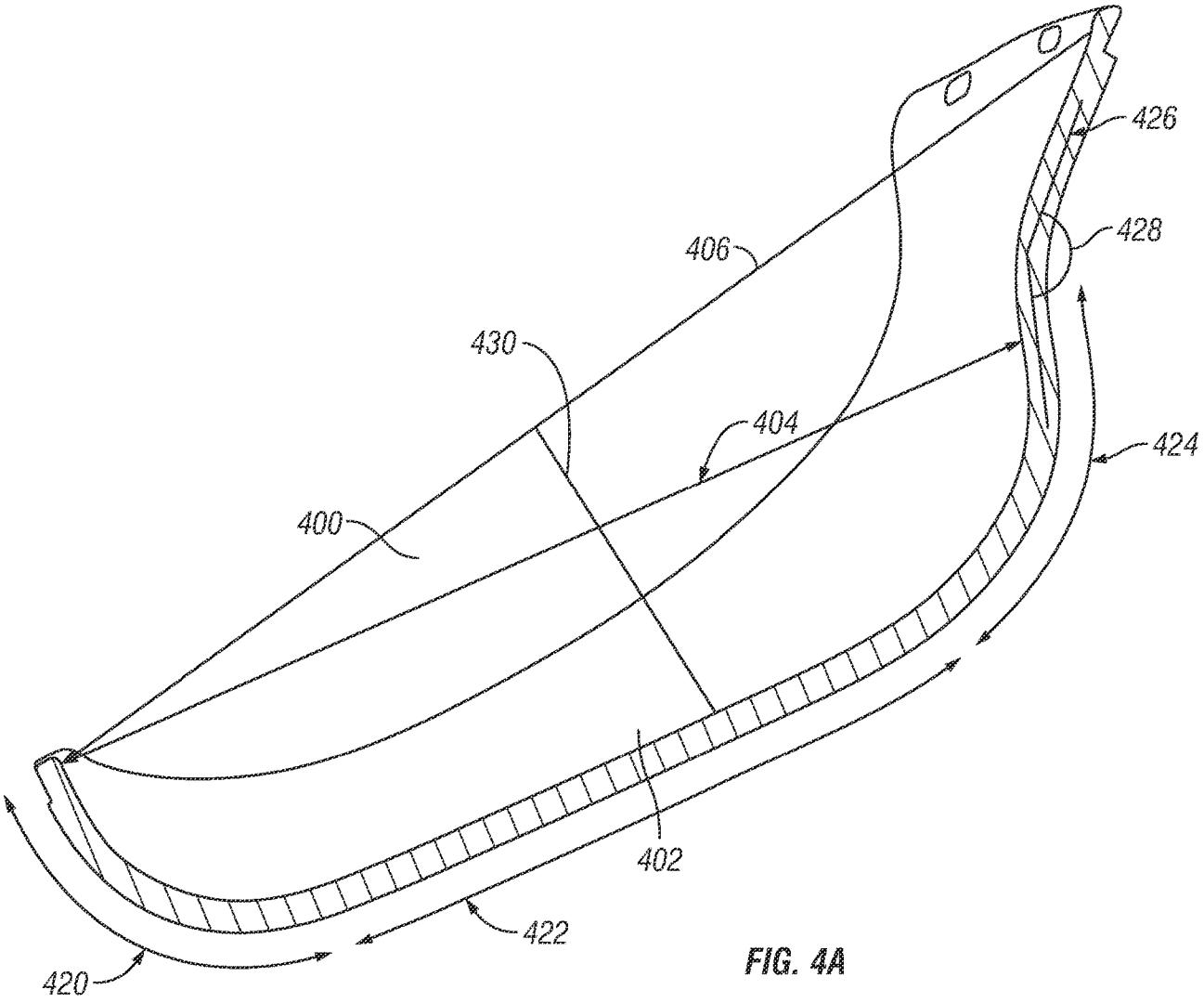
FIG. 4A illustrates a scale drawing of a cross-section of a preformed lacrosse pocket along the central axis of the pocket in accordance with embodiments of present disclosure.

FIG. 4A illustrates a scale drawing of a cross-section of a preformed lacrosse pocket along the central axis of the pocket in accordance with embodiments of present disclosure. A cross section of preformed lacrosse pocket 400 may be taken along a central axis of that pocket, for example central axis 214, shown above with reference to FIG. 2. As described with reference to FIG. 3, preformed lacrosse pockets in accordance with the present disclosure may have a longer channel as compared to conventional lacrosse pockets. Length 404 of channel 402 may be computed as a percentage of the total length 406 of preformed lacrosse pocket 400. As depicted in FIG. 4, channel 404 may be approximately 80% of a total length of preformed lacrosse pocket 400. In further embodiments, length 404 may be about 50%, 55%, 60%, 65%, 70%, 75%, 80%, 85%, 90%, or up to 95% of the total length 406 of preformed lacrosse pocket 400. The increased length of channel 402 as compared to conventional lacrosse pockets may have numerous advantages. For example, to adjust a conventional pocket so that throwing a ball is accurate; a player may use strings running across the top third of the pocket to expel the ball. These "shooting strings" are normally located within the top four inches of the pocket and attach to the sidewalls of the head, before the transition from the sidewalls of the head to the scoop section. These shooting strings are typically tied with high tension, causing the top portion of a conventional pocket to be relatively rigid. While necessary for throwing, these shooting strings thus create a sizeable area of a conventional pocket that is unable to receive the ball. In addition, when scooping a ball from the ground, the ball must pass over the shooting strings into the lower portion of the pocket before a player can possess the ball. By contrast a preformed lacrosse pocket in accordance with embodiments of the present disclosure may have a longer channel, and consequently a shorter scoop zone. Thus, the distance between the scoop portion of a lacrosse head and channel 402 may be shorter, allowing a player to more easily move a lacrosse ball into channel 402. In addition, a preformed lacrosse pocket in accordance with embodiments of the present disclosure may provide the function of shooting strings through its permanent shape, resulting in the highest possible pocket area for receiving the ball and the shortest possible distance to scoop a ball from the ground.

FIG. 4A also illustrates the availability of a hybrid pocket design. In conventional lacrosse pockets, the location of the deepest part of the pocket is normally limited to one of three choices, referred to as: a high pocket, a mid pocket or a low pocket. In a high pocket, the deepest part of the lacrosse pocket may be closest to the scoop end of a lacrosse head. In a low pocket, the deepest part of the lacrosse pocket may be closer to the throat end of a lacrosse head. In a mid pocket configuration, the deepest part of the lacrosse pocket may be approximately centered between the throat end of a lacrosse head and the scoop end of a lacrosse head. The location of the deepest part of the pocket may affect the performance of a lacrosse pocket.

Generally, lacrosse players may prefer to realize the benefits of having a high pocket because a high pocket may allow the highest passing accuracy, highest ball velocity, largest area to receive passes and may be most effective for scooping a ball from the ground. However, a high pocket also may be most difficult to maintain because the pocket will throw less accurately from a small change in pocket depth. Accordingly, even minor stretching or distortion of the mesh or shooting strings in a high pocket lacrosse pocket may cause a large change in playing performance. Also, a high pocket using traditional or mesh materials may have little space for the lacrosse ball at the bottom of the pocket. Most players desire this bottom space to assist with retaining the ball when carrying the lacrosse stick in one hand. Because of the limitations of a high pocket, many players opt for a mid or low pocket, and consequently may be limited when passing, catching and scooping.

By contrast, a low pocket may have higher ball retention characteristics as compared to a high pocket. When a player cradles the lacrosse stick with one hand, a low pocket may be most effective at retaining possession of the ball.

Previously, players have been unable to realize the combined benefits of both a low pocket and a high pocket in a single lacrosse pocket often because such a conventional pocket would exceed the maximum allowable pocket depth.

Preformed lacrosse pockets in accordance with embodiments of the present disclosure may include a hybrid pocket. A hybrid pocket may include two primary curves defining portions of the pocket, rather than having a single deepest part: one towards the throat end of the head, and one towards the scoop end of the head. A hybrid pocket in accordance with the present disclosure may thus realize a simultaneous combination of the benefits of both a conventional high-pocket and a conventional low pocket. For example, a hybrid pocket may have comparable performance to a conventional high pocket for actions such as throwing, catching, and scooping. Likewise, a hybrid pocket may realize the benefits of a conventional low pocket. For example, a hybrid pocket may enable a player to retain a lacrosse ball close to the throat of a lacrosse stick when the stick is carried in one hand. A hybrid pocket according to the present disclosure may achieve this combination of benefits while also maintaining a permissible allowable pocket depth.

As depicted in FIG. 4A, preformed lacrosse pocket 400 may be formed with two primary curves defining a shape of a channel. For example, ball stop curve 420 may include a portion of preformed lacrosse pocket 400 closest to a throat of a lacrosse head. Ball stop curve 420 may have a radius approximately the same as the radius of a lacrosse ball. In further embodiments ball stop curve 420 may have a radius of between about 15 mm and 45 mm, measured in a cross section on a central axis of preformed lacrosse pocket 400. Ball stop curve 402 may be adjacent to channel back 422. Channel back 422 may be substantially straight, and may extend distally away from ball stop curve 420 toward the scoop end of a lacrosse head. Channel back 422 may have a length of between about 90 mm and 180 mm measured in a cross section on a central axis of preformed lacrosse pocket 400. Channel back 422 may be adjacent to scoop curve 424. Scoop curve 424 may curve upward and away from channel back 422 towards scoop zone 426. Scoop curve 424 may have a radius of between about 30 mm and about 100 mm measured in a cross section on a central axis of preformed lacrosse pocket 400. Angle 428 between scoop curve 424 and scoop zone 426 may be between about 0 degrees and about 45 degrees.

Figure 4B:
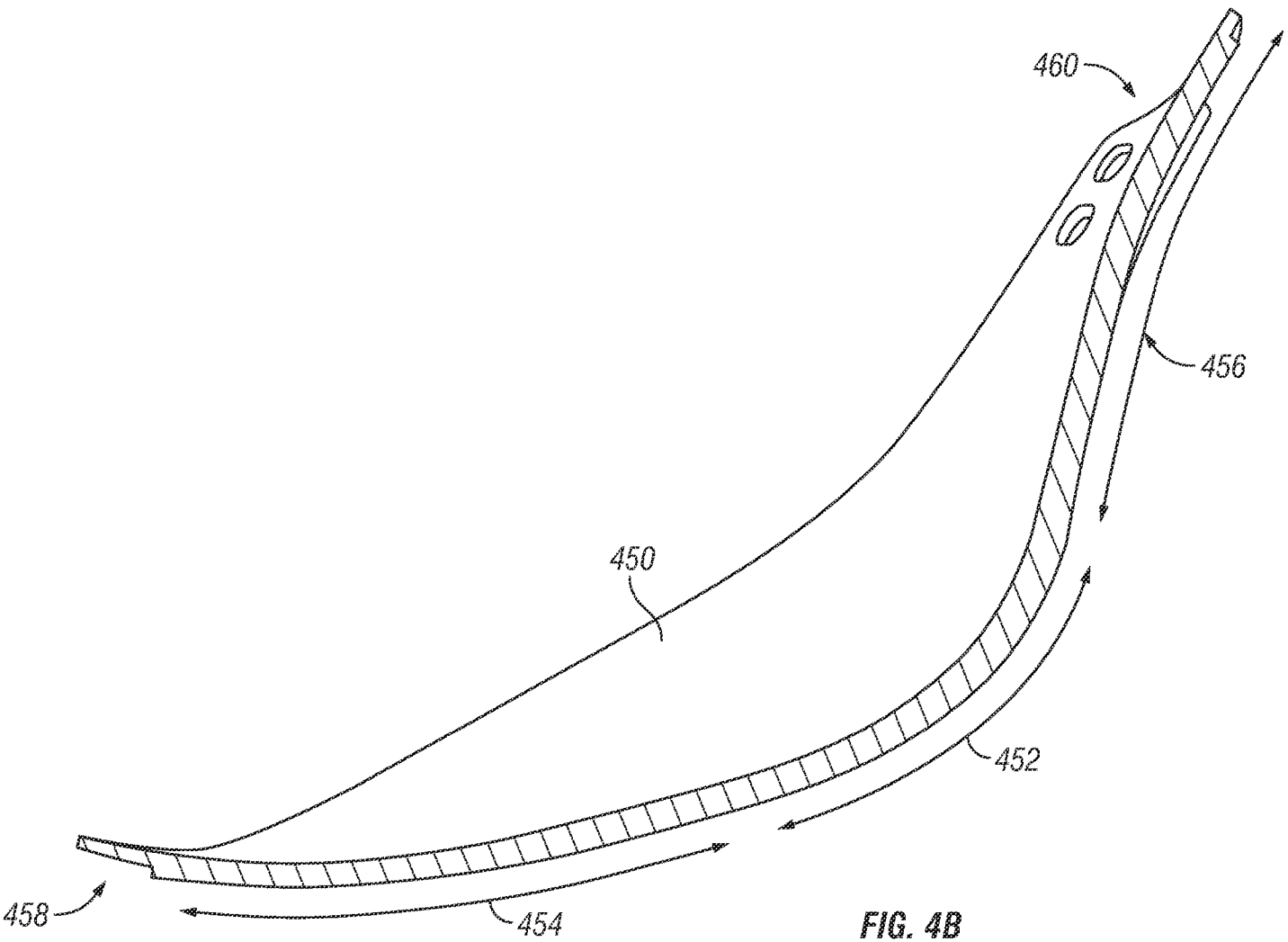
FIG. 4B illustrates a scale cross-section of a preformed lacrosse pocket configured with a high pocket in accordance with embodiments of the present disclosure.

FIG. 4B illustrates a scale cross-section of a preformed lacrosse pocket configured with a high pocket in accordance with embodiments of the present disclosure. Although a hybrid pocket may provide improved playing characteristics, it is also possible to design a preformed lacrosse pocket to emulate pockets configurations available with conventional pockets. For example, preformed lacrosse pocket 450 may have a high pocket configuration. Rather than being formed from two primary curves (like the hybrid pocket depicted in FIG. 4A), preformed lacrosse pocket 450 may have a single primary pocket curve 452. Pocket curve 452 may have a radius of between about 30 mm and about 100 mm measured in a cross section on a central axis of preformed lacrosse pocket 450. In the example of a high pocket preformed lacrosse pocket depicted in FIG. 4B, primary curve 452 may be located approximately in the top half or the top third between the scoop end and the throat end of a lacrosse head. Accordingly, distance 454 between primary curve 452 and throat zone 458 may be approximately 1.5 to 2.5 times as long as zone 456 between primary curve 452 and scoop zone 460. In further embodiments, however, the location of primary curve 452 may be varied to be closer to or further away from the throat end of a lacrosse head depending on the desired playing characteristics of preformed lacrosse pocket 450.

Figure 5:
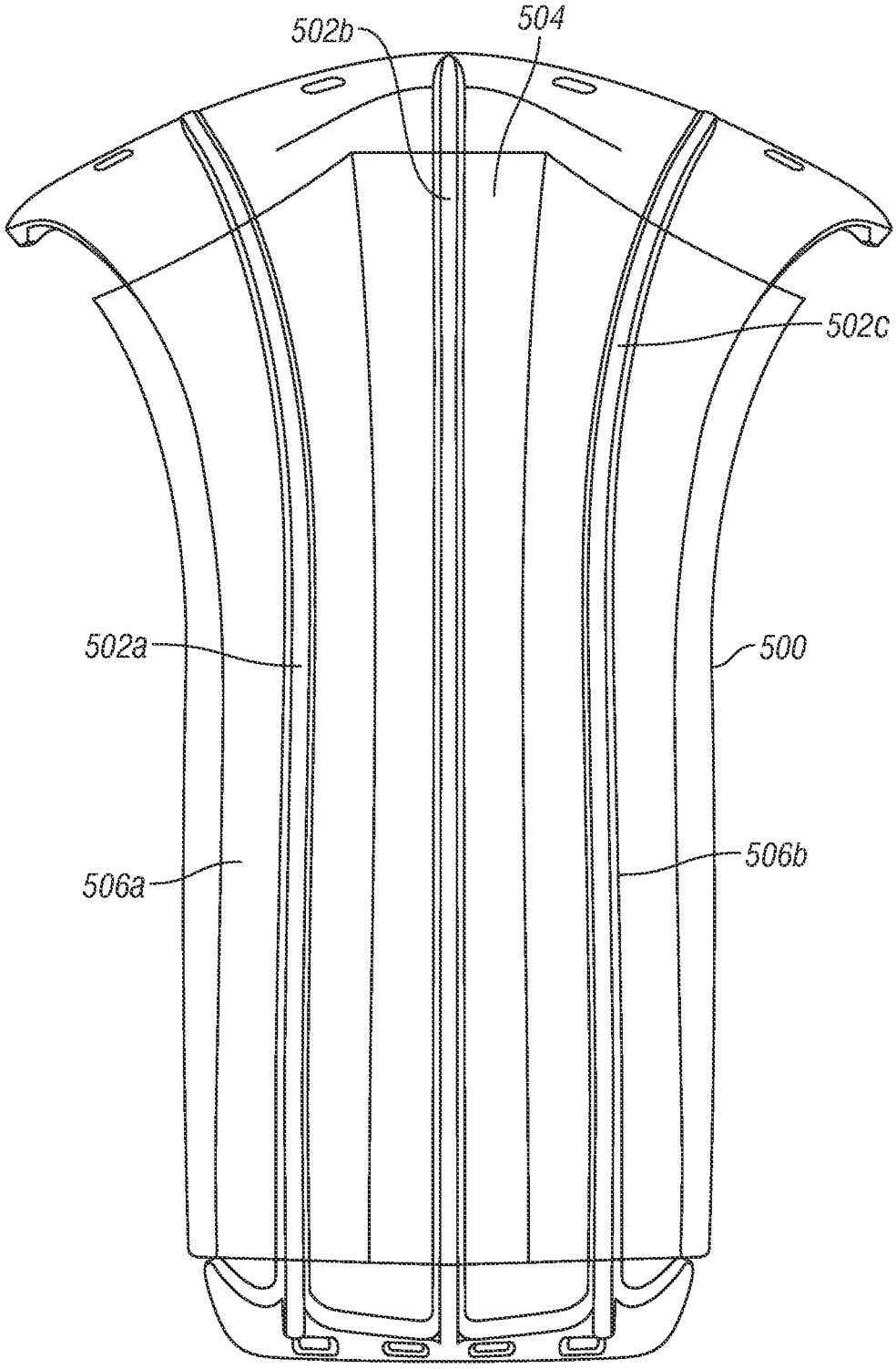
FIG. 5 illustrates a scale rear view of a preformed lacrosse pocket including reinforcing ridges in accordance with embodiments of the present disclosure.

FIG. 5 illustrates a scale rear view of a preformed lacrosse pocket including reinforcing ridges in accordance with embodiments of the present disclosure. Lacrosse players often prefer lower-weight products, including lacrosse sticks, and thus lacrosse pockets. Accordingly, preformed lacrosse pockets may be designed to minimize the amount of material included in a preformed lacrosse pocket. This may be accomplished by designing a preformed lacrosse pocket to be thinner. However, if the preformed lacrosse pocket is too thin, the pocket material may stretch or tear with repeated use. Accordingly, in some configurations, a performed lacrosse pocket may be designed with reinforcing ridges. For example, preformed lacrosse pocket 500 may include reinforcing ridges 502*a*, 502*b* and 502*c* (collectively "reinforcing ridges 502") on the back side of preformed lacrosse pocket 500. Reinforcing ridges 502 may be formed from the same material as preformed lacrosse pocket 500, or may be formed from a different material. Reinforcing ridges 502 may be formed integrally with preformed lacrosse pocket 500, or may be formed separately and then joined to preformed lacrosse pocket. In some embodiments, reinforcing ridges may be formed using a co-molding injection process. In a co-molding process, reinforcing ridges 502 may be injection molded from a first material in a first mold. The formed reinforcing ridges may then be placed in a second mold where remaining portions of preformed lacrosse pocket 500 may be injection molded and bonded to reinforcing ridges 502. Alternatively, reinforcing ridges 502 may be separately molded, then affixed to preformed lacrosse pocket by any suitable means. Reinforcing ridges 502 may have a thickness that varies between about 100% and about 300% of the thickness of the remaining portions of preformed lacrosse pocket 500. Many suitable configurations of reinforcing ridges are possible. For example, as shown in FIG. 5, three reinforcing ridges may be used. Reinforcing ridges 502 may run from the scoop end of preformed lacrosse head 500 to the throat end of the preformed lacrosse head 500. Reinforcing ridge 502*b* may run along a central axis of preformed lacrosse head 500, in channel zone 504. Reinforcing ridges 502*a* and 502*c* may parallel to reinforcing ridge 502*b*, in sidewall zones 506*a* and 506*b*, respectively. However, any suitable number of reinforcing ridges 502 may be used, and any suitable layout of reinforcing ridges 502 may be implemented. In some embodiments where reinforcing ridges 502 are formed separately from preformed lacrosse pocket 500, reinforcing ridges 502 may be formed from an opaque or colored material, while the remainder of preformed lacrosse pocket 500 may be formed from an optically clear material. In further embodiments, both reinforcing ridges 502 and the remainder of preformed lacrosse pocket 500 may be optically clear.

Figure 6:
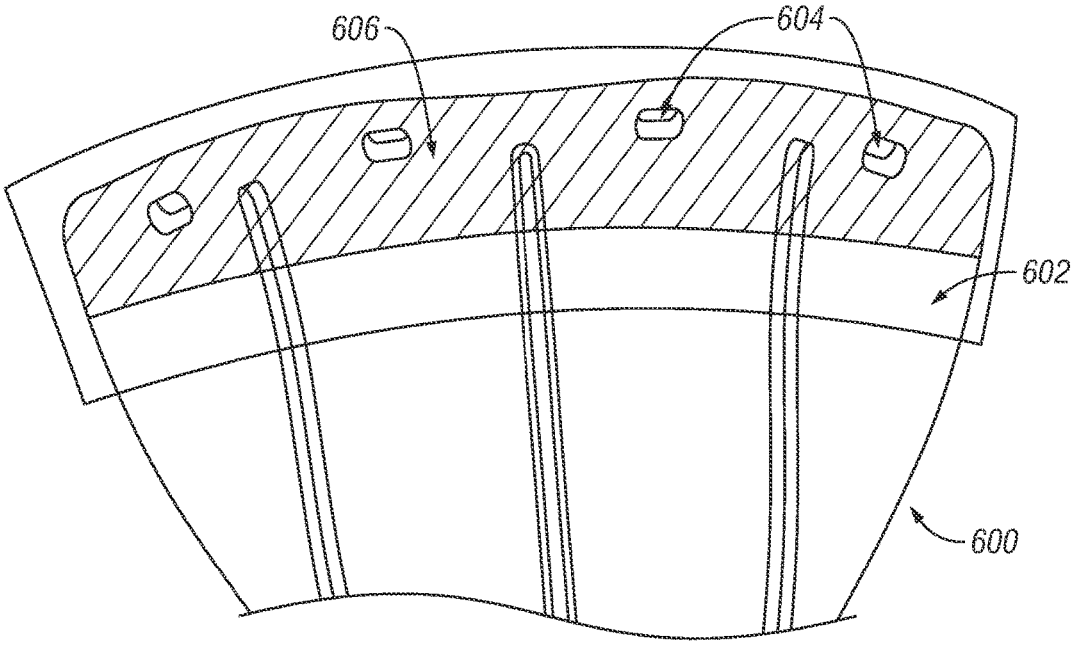
FIG. 6 illustrates an elevation view of the back of a preformed lacrosse pocket in accordance with embodiments of the present disclosure.

FIG. 6 illustrates an elevation view of the back of a preformed lacrosse pocket in accordance with embodiments of the present disclosure. As described above with reference to FIG. 1, preformed lacrosse pocket 600 may include scoop zone 602. Scoop zone 602 may include a plurality of scoop fastener apertures 604 configured to be coupled to a scoop region of a lacrosse head, such as scoop region 112 of head 104, described above with reference to FIG. 1. Fasteners may include elastic loops, strings, zip-ties, wires, bands of rubber, or any other suitable fastener. Fasteners may be placed through scoop fastener apertures 604 and around a portion of a lacrosse head. Fasteners may be tensioned to couple preformed lacrosse pocket 600 to a lacrosse head. Preformed lacrosse pocket 600 may optionally include scoop reinforcing zone 606. Scoop reinforcing zone 606 may operate to increase the structural integrity of the portion of preformed lacrosse pocket 600 proximate to scoop fastener apertures 604. Scoop reinforcing zone 606 may be formed from the same material as preformed lacrosse pocket 600, or may be formed from a different material. Scoop reinforcing zone 606 may be formed integrally with preformed lacrosse pocket 600, or may be formed separately and then joined to preformed lacrosse pocket. In some embodiments, scoop reinforcing zone 606 may be formed using a co-molding injection process. In a co-molding process, scoop reinforcing zone 606 may be injection molded from a first material in a first mold. The formed reinforcing zone may then be placed in a second mold where remaining portions of preformed lacrosse pocket 600 may be injection molded and bonded to scoop reinforcing zone 606. Alternatively, the reinforcing zone may be separately molded, then affixed to preformed lacrosse pocket by any suitable means. Scoop reinforcing zone 606 may have a thickness that varies between about 100% and about 300% of the thickness of the remaining portions of preformed lacrosse pocket 600. In some embodiments where scoop reinforcing zone 606 is formed separately from preformed lacrosse pocket 600, scoop reinforcing zone 606 may be formed from an opaque or colored material, while the remainder of preformed lacrosse pocket 600 may be formed from an optically clear material. In further embodiments, both scoop reinforcing zone 606 and the remainder of preformed lacrosse pocket 600 may be optically clear.

Figure 7:
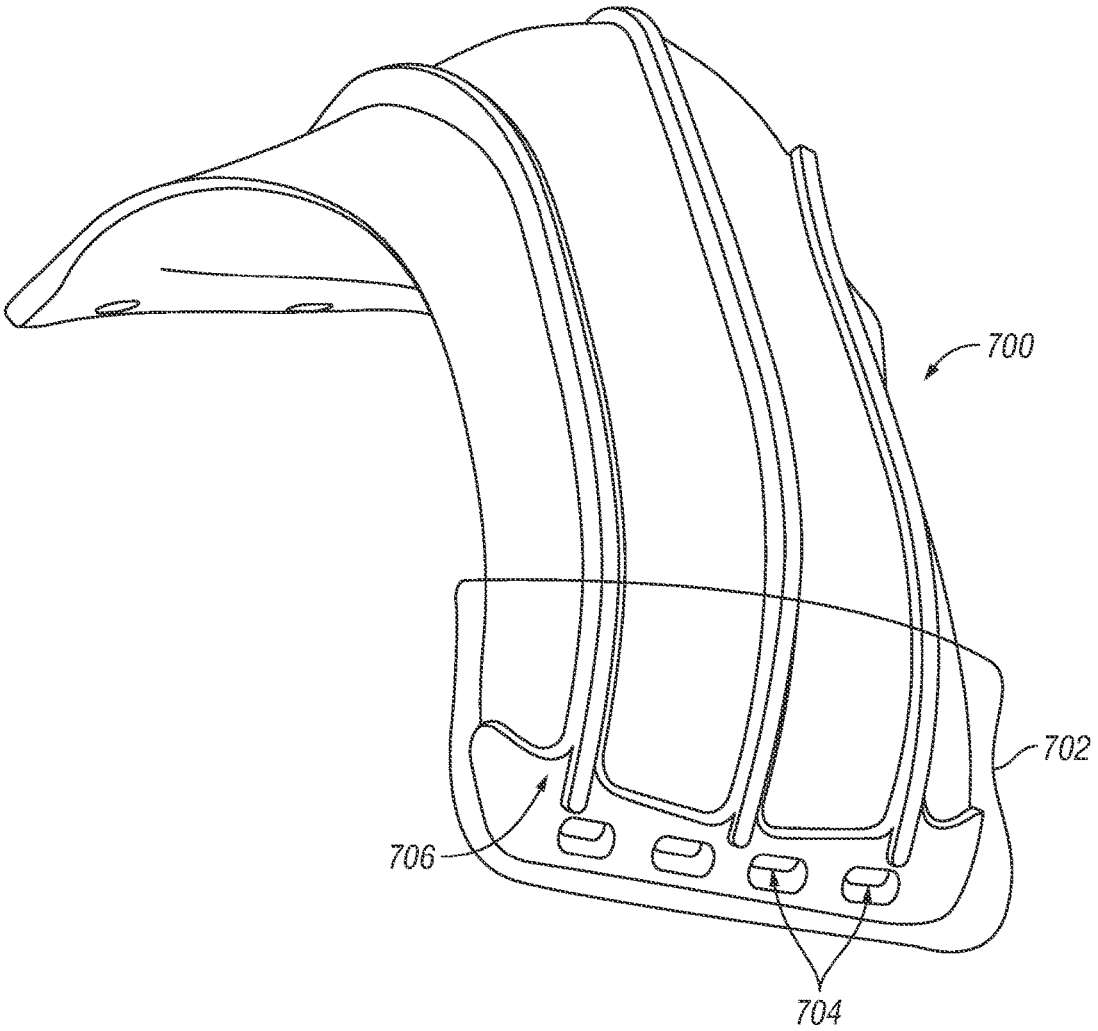
FIG. 7 illustrates an elevation view of the back of a preformed lacrosse pocket in accordance with embodiments of the present disclosure.

FIG. 7 illustrates an elevation view of the back of a preformed lacrosse pocket in accordance with embodiments of the present disclosure. As described above with reference to FIG. 1, preformed lacrosse pocket 700 may include throat zone 702. Throat zone 702 may include a plurality of throat fasteners apertures 704 configured to be coupled to a throat region of a lacrosse head, such as throat region 108 of head 104, described above with reference to FIG. 1. Fasteners may include elastic loops, strings, zip-ties, wires, bands of rubber, or any other suitable fastener. Fasteners may be placed through throat fasteners apertures 704 and around a portion of a lacrosse head. Fasteners may be tensioned to couple preformed lacrosse pocket 700 to a lacrosse head. Preformed lacrosse pocket 700 may optionally include throat reinforcing zone 706. Throat reinforcing zone 706 may operate to increase the structural integrity of the portion of preformed lacrosse pocket 700 proximate to throat fasteners apertures 704. Throat reinforcing zone 706 may be formed from the same material as preformed lacrosse pocket 700, or may be formed from a different material. Throat reinforcing zone 706 may be formed integrally with preformed lacrosse pocket 700, or may be formed separately and then joined to preformed lacrosse pocket. In some embodiments, throat reinforcing zone 706 may be formed using a co-molding injection process. In a co-molding process, throat reinforcing zone 706 may be injection molded from a first material in a first mold. The formed reinforcing zone may then be placed in a second mold where remaining portions of preformed lacrosse pocket 700 may be injection molded and bonded to throat reinforcing zone 702. Throat reinforcing zone 702 may be formed from any suitable pocket material, and may be joined to preformed lacrosse pocket by any suitable means. Throat reinforcing zone 706 may have a thickness that varies between about 100% and about 300% of the thickness of the remaining portions of preformed lacrosse pocket 700. In some embodiments where throat reinforcing zone 706 is formed separately from preformed lacrosse pocket 700, throat reinforcing zone 706 may be formed from an opaque or colored material, while the remainder of preformed lacrosse pocket 700 may be formed from an optically clear material. In further embodiments, both throat reinforcing zone 706 and the remainder of preformed lacrosse pocket 700 may be optically clear.

Returning to FIG. 1, the top of preformed lacrosse pocket 106 may be coupled to the front side of scoop region 112. Conventional lacrosse pockets attach to the back of the scoop region of a lacrosse head because the conventional lacrosse pockets often include excess material that could interfere with the ability to catch, throw or retain a lacrosse ball. As depicted in FIG. 1, the top of preformed lacrosse pocket 106 may attach to the front of the lacrosse head. Front mounting preformed lacrosse pocket 106 may operate to protect the top edge of the pocket from damage and to improve the stability of the pocket in the head. Fasteners 114 may be used to attach preformed lacrosse pocket 106 to scoop region 112. Fasteners may include elastic loops, strings, zip-ties, wires, bands of rubber, or any other suitable fastener. It is preferred that fasteners 114 be elastic loops. Elastic loops may retain their shape, while also exerting sufficient force to couple preformed lacrosse pocket 106 to head 104.

This disclosure encompasses all changes, substitutions, variations, alterations, and modifications to the example embodiments herein that a person having ordinary skill in the art would comprehend. For example, while the embodiments of FIGS. 1-7 illustrate particular configurations of preformed lacrosse pockets, any suitable configuration may be used. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A preformed lacrosse pocket, comprising a pocket material formed to include:

a throat zone;

a channel zone adjacent to the throat zone extending distally from the throat zone, wherein the channel zone has a channel zone length along a central longitudinal axis of the pocket;

a pair of sidewall zones adjacent to the channel zone; and a scoop zone adjacent to the channel zone and the pair of sidewall zones, wherein the channel zone defines a hybrid pocket with an interior, the hybrid pocket including:

a low pocket comprising a ball stop curve proximate to the throat zone, wherein the ball stop curve is concave toward the interior of the hybrid pocket and has a ball stop radius between approximately 15 millimeters and 45 millimeters measured in a cross section on the central longitudinal axis;

a channel back adjacent to the ball stop curve, the channel back being substantially straight along the central longitudinal axis, extending distally away from the ball stop curve toward the scoop zone, and having a length less than the channel zone length and between approximately 90 millimeters and 180 millimeters measured in the cross section on the central longitudinal axis; and a high pocket comprising a scoop curve adjacent to the channel back and the scoop zone, wherein the scoop curve is concave toward the interior of the hybrid pocket and has a scoop curve radius between approximately 30 millimeters and 100 millimeters measured in the cross section on the central longitudinal axis.

2. The preformed lacrosse pocket of claim 1, wherein the pocket material is optically clear or translucent.

3. The preformed lacrosse pocket of claim 1, wherein the pocket material has a thickness of between approximately 0.5 mm and 5 mm.

4. The preformed lacrosse pocket of claim 1, further comprising a plurality of reinforcing ridges, the plurality of reinforcing ridges attached to a rear of the channel zone, at least one of the pair of sidewall zones, or both the channel zone and at least one of the pair of sidewall zones.

5. The preformed lacrosse pocket of claim 4, wherein the plurality of reinforcing ridges are attached to the rear of the channel zone, at least one of the pair of sidewall zones, or both the channel zone and at least one of the pair of sidewall zones using a co-molding process.

6. The preformed lacrosse pocket of claim 5, wherein the plurality of reinforcing ridges are formed from a second pocket material.

7. The preformed lacrosse pocket of claim 1, further comprising a throat reinforcing region, the throat reinforcing region attached to a back side of the throat zone.

8. The preformed lacrosse pocket of claim 7, wherein the throat reinforcing region is attached to the back side of the throat zone using a co-molding process.

9. The preformed lacrosse pocket of claim 1, further comprising a scoop reinforcing region, the scoop reinforcing region attached to a back side of the scoop zone.

10. The preformed lacrosse pocket of claim 9, wherein the scoop reinforcing region is attached to the back side of the scoop zone using a co-molding process.

11. The preformed lacrosse pocket of claim 1, wherein the pocket material is a thermoplastic elastomer.

12. A lacrosse head, comprising:

a frame including:

a throat region;

a pair of side regions, adjacent to the throat region; and a scoop region, adjacent to the pair of side regions; and a preformed lacrosse pocket, coupled to the frame and including a pocket material formed to include:

a throat zone;

a channel zone adjacent to the throat zone extending distally from the throat zone, wherein the channel zone has a channel zone length along a central longitudinal axis of the pocket;

a pair of sidewall zones adjacent to the channel zone; and a scoop zone adjacent to the channel zone and the pair of sidewall zones, wherein the channel zone defines a hybrid pocket with an interior, the hybrid pocket including:

a low pocket comprising a ball stop curve proximate to the throat zone, wherein the ball stop curve is concave toward the interior of the hybrid pocket and has a ball stop radius between approximately 15 millimeters and 45 millimeters measured in a cross section on the central longitudinal axis;

a channel back adjacent to the ball stop curve, the channel back being substantially straight along the central longitudinal axis, extending distally away from the ball stop curve toward the scoop zone, and having a length less than the channel zone length and between approximately 90 millimeters and 180 millimeters measured in the cross section on the central longitudinal axis; and a high pocket comprising a scoop curve adjacent to the channel back and the scoop zone, wherein the scoop curve is concave toward the interior of the hybrid pocket and has a scoop curve radius between approximately 30 millimeters and 100 millimeters measured in the cross section on the central longitudinal axis.

13. The lacrosse head of claim 12, wherein the pocket material is optically clear or translucent.

14. The lacrosse head of claim 12, wherein the pocket material has a thickness of between 0.5 mm and 5 mm.

15. The lacrosse head of claim 12, wherein the preformed lacrosse pocket further comprises a plurality of reinforcing ridges, the plurality of reinforcing ridges attached to a rear of the channel zone, at least one of the pair of sidewall zones, or both the channel zone and at least one of the pair of sidewall zones.

16. The lacrosse head of claim 15, wherein the plurality of reinforcing ridges are attached to the rear of the channel zone, at least one of the pair of sidewall zones, or both the channel zone and at least one of the pair of sidewall zones using a co-molding process.

17. The lacrosse head of claim 16, wherein the plurality of reinforcing ridges are formed from a second pocket material.

18. The lacrosse head of claim 12, wherein the preformed lacrosse pocket further comprises a throat reinforcing region, the throat reinforcing region attached to a back side of the throat zone.

19. The lacrosse head of claim 18, wherein the throat reinforcing region is attached to the back side of the throat zone using a co-molding process.

20. The lacrosse head of claim 12, wherein the preformed lacrosse pocket further comprises a scoop reinforcing region, the scoop reinforcing region attached to a back side of the scoop zone.

21. The lacrosse head of claim 20, wherein the scoop reinforcing region is attached to the back side of the scoop zone using a co-molding process.

22. The lacrosse head of claim 12, wherein the scoop zone is attached to a front side of the scoop region of the lacrosse head.

23. The lacrosse head of claim 12, wherein the pocket material is thermoplastic elastomer.

24. A lacrosse stick, comprising:

a handle;

a lacrosse head coupled to the handle, and including:

a throat region;

a pair of side regions, adjacent to the throat region; and a scoop region, adjacent to the pair of side regions; and a preformed lacrosse pocket, coupled to the lacrosse head, including a pocket material formed to include:

a throat zone;

a channel zone adjacent to the throat zone extending distally from the throat zone, wherein the channel zone has a channel zone length along a central longitudinal axis of the pocket;

a pair of sidewall zones adjacent to the channel zone; and a scoop zone adjacent to the channel zone and the pair of sidewall zones, wherein the channel zone defines a hybrid pocket with an interior, the hybrid pocket including:

a low pocket comprising a ball stop curve proximate to the throat zone, wherein the ball stop curve is concave toward the interior of the hybrid pocket and has a ball stop radius between approximately 15 millimeters and 45 millimeters measured in a cross section on the central longitudinal axis;

a channel back adjacent to the ball stop curve, the channel back being substantially straight along the central longitudinal axis, extending distally away from the ball stop curve toward the scoop zone, and having a length less than the channel zone length and between approximately 90 millimeters and 180 millimeters measured in the cross section on the central longitudinal axis; and a high pocket comprising a scoop curve adjacent to the channel back and the scoop zone, wherein the scoop curve is concave toward the interior of the hybrid pocket and has a scoop curve radius between approximately 30 millimeters and 100 millimeters measured in the cross section on the central longitudinal axis.

25. The lacrosse stick of claim 24, wherein the pocket material is optically clear or translucent.

26. The lacrosse stick of claim 24, wherein the pocket material has a thickness of between 0.5 mm and 5 mm.

27. The lacrosse stick of claim 24, wherein the preformed lacrosse pocket further comprises a plurality of reinforcing ridges, the plurality of reinforcing ridges attached to a rear of the channel zone, at least one of the pair of sidewall zones, or both the channel zone and at least one of the pair of sidewall zones.

28. The lacrosse stick of claim 27, wherein the plurality of reinforcing ridges are attached to the rear of the channel zone, at least one of the pair of sidewall zones, or both the channel zone and at least one of the pair of sidewall zones using a co-molding process.

29. The lacrosse stick of claim 28, wherein the plurality of reinforcing ridges are formed from a second pocket material.

30. The lacrosse stick of claim 24, wherein the preformed lacrosse pocket further comprises a throat reinforcing region, the throat reinforcing region attached to a back side of the throat zone.

31. The lacrosse stick of claim 30, wherein the throat reinforcing region is attached to the back side of the throat zone using a co-molding process.

32. The lacrosse stick of claim 24, wherein the preformed lacrosse pocket further comprises a scoop reinforcing region, the scoop reinforcing region attached to a back_side of the scoop zone.

33. The lacrosse head of claim 32, wherein the scoop reinforcing region is attached to the back side of the scoop zone using a co-molding process.

34. The lacrosse stick of claim 24, wherein the scoop zone is attached to a front side of the scoop region of the lacrosse head.

35. The lacrosse stick of claim 24, wherein the pocket material is thermoplastic elastomer.

* * * * *